United States Patent [19]

Buschbom

[11] Patent Number: 4,797,004

[45] Date of Patent: Jan. 10, 1989

[54] MATERIAL MIXER

[75] Inventor: Floyd E. Buschbom, Long Lake, Minn.

[73] Assignee: Van Dale Inc., Long Lake, Minn.

[21] Appl. No.: 101,858

[22] Filed: Sep. 28, 1987

[51] Int. Cl.[4] ..... B01F 15/02

[52] U.S. Cl. ..... 366/186; 366/224

[58] Field of Search ..... 366/184, 186, 187, 188, 366/194, 195, 196, 224, 225, 228, 50, 56, 68, 54, 63; 68/139

[56] References Cited

U.S. PATENT DOCUMENTS

| | | | |
|---|---|---|---|
| 1,708,947 | 4/1929 | Jeager . | |
| 3,085,789 | 4/1963 | Heider . | |
| 3,153,494 | 10/1964 | Heider . | |
| 3,356,270 | 12/1967 | Heider . | |
| 3,552,721 | 1/1971 | Phillips | 366/225 |
| 3,712,494 | 1/1973 | Lindeborg . | |
| 4,423,961 | 1/1984 | Steiner | 366/188 |
| 4,500,209 | 2/1985 | Steiner | 366/224 |

*Primary Examiner*—Robert W. Jenkins

*Attorney, Agent, or Firm*—Burd, Bartz & Gutenkauf

[57] ABSTRACT

A particulate material mixer has a rotatable drum with an inclined longitudinal axis. A conveyor having an open top trough and auger is located longitudinally in the drum and operates to move mixed material from the drum chamber into a hopper or alternatively back into the chamber. A drive transmission simultaneously rotates the drum and operates the conveyor. A flexible circular seal interposed between an annular end wall and a circular wall of the drum prevents material from spilling out of the drum. The conveyor trough is mounted for angular movement to regulate the volume of material discharged from the mixer. A manually operated liner actuator allows the operator to select the angular position of the trough. The hopper has a discharge door and chute to direct mixed material away from the mixer to a desired location.

31 Claims, 5 Drawing Sheets

MATERIAL MIXER

FIELD OF THE INVENTION

The invention relates to a machine having a rotatable drum to mix particulate materials, such as animal feed and roughages. The machine is a batch mixer having a rotatable drum associated with a conveyor for throughly mixing particulate materials and allowing complete controlled discharge of the mixed materials from the drum.

BACKGROUND OF THE INVENTION

Material mixers having cylindrical rotatable drums providing a mixing chamber for particulate materials are used to mix animal feeds and roughages. The drum is driven with a power driven transmission to mix particulate materials through combined turning and tumbling action. An enclosed conveyor having a fixed auger trough, is used to carry the material from the drum chamber to a discharge opening. This machine does utilize the full capacity of the conveyor to facilitate thorough mixing of the particulate materials. A machine having a cylindrical drum with an open top mounted on a generally horizontal shaft to mix material is disclosed in U.S. Pat. No. 1,708,947. A plurality of mixing blades are mounted on the shaft whereby rotation of the shaft will mix material within the drum. The drum is rotated to facilitate the discharge of the material from the drum chamber through a discharge chute.

SUMMARY OF THE INVENTION

The invention relates to an apparatus for mixing a plurality of particulate materials, such as roughage and feed rations for diary cattle. The apparatus has a rotatable drum having a chamber that is used to mix the particulate materials. An internal trough and auger cooperates with the rotating drum to provide a complete and rapid mixing of the particulate materials as well as the control discharge of the mixed particulate materials. This produces quality controlled rations that are desirable for maximum dairy production from the herd.

An embodiment of the apparatus has an elongated cylindrical drum having an inclined longitudinal axis extended from an inlet end to a closed end. The drum has an internal mixing chamber for accommodating the particulate materials to be mixed. A hopper is located adjacent the inlet end of the drum to facilitate the depositing of particulate materials into the chamber. The hopper includes a discharge door and chute which directs the mixed materials away from the apparatus to a desired location such as a conveyor or vehicle for moving the mixed materials to a feed bunk or trough. The drum is supported for rotation about its longitudinal axis on a support frame which can be associated with a balanced beam scale. The scale is used to weigh the amount of materials that are loaded into the drum. The drum is located at an incline that extends downwardly from the inlet end thereof. A conveyor is located longitudinally in the mixing chamber between its inlet and closed ends and operates to move the mixed material from the closed end of the chamber into the hopper or alternatively direct mixed material back into the mixing chamber. A drive transmission operates to simultaneously rotate the drum about its longitudinal axis and operate the conveyor. The conveyor has an open top trough that surrounds a elongated auger. The auger is mounted on a shaft that is connected to the drive transmission which rotates the auger. The trough is mounted on the shaft for angular movement about the longitudinal axis of the shaft and auger. The trough is moved from a generally horizontal position to an angular or tilt position by a control. The control is a manually operated linear actuator that allows the operator to select the angular or horizontal position of the trough to regulate the volume of material conveyance in the mixing chamber. When the trough is in its horizontal position, the material rapidly cycles within the mixing chamber since the auger moves the material from the closed end of the drum into the hopper which directs material back into the inlet end of the drum. When the trough has been angularly moved to a tilt position, the auger moves the material in the trough over a lower longitudinal edge of the trough back into the mixing chamber. This reduces the cycling of the material in the mixing chamber as all of the material is not moved by the auger back into the hopper for discharge into the inlet end of the drum. The end wall and side walls of the drum have blades and paddles which pick up the particulate materials in the bottom of the drum and carry the materials to the upper portions of the drum chamber. The particulate materials fall back down into the drum chamber or into the open top trough. The auger of the conveyer moves the material into the hopper which directs the material back into the upper inlet end of the mixing chamber. This process is repeated as the particulate materials are cycled through the mixing chamber to provide a rapid and thorough mixing of the particulate materials.

The drum has an annular end wall at the inlet end thereof. The housing includes a stationary generally circular wall that is located adjacent and surrounded by the annular end wall. A flexible circular seal is interposed between the annular end wall and circular wall to prevent the particulate materials from flowing out of the drum. The circular wall has a circular outer peripheral edge that supports a circular bead. The seal includes a flexible annular belt-like member that is secured to the annular end wall and engageable with the circular bead to effectively close the annular space between the annular end wall and circular wall.

The mixed material is discharged from the drum with the use of a discharge chute operatively associated with a door at the bottom of the hopper. The angle of the U-shaped trough can be set for a desired rate of discharge of the mixed materials into discharge chute. There is no need to stop the rotating drum or reverse its direction of rotation to remove mixed material from the mixing chamber. The manual control located externally of the drum is easily and accurately operated to achieve the desired rate of discharge of mixed materials.

The conveyor, with its angularly movable trough, provides for the selective discharge of mixed materials to separate selected areas which in the mixing apparatus is the mixing chamber of the drum or hopper at the inlet end of the drum. The rate of the material discharged into the hopper by the conveyor is adjustable by changing the angular orientation of the open top trough of the conveyor. When the conveyor trough is in the horizontal position, the maximum amount of material is carried by the conveyor into the hopper. The tilting or the angular orientation of the open top trough selectively adjusts the rate of discharge of the mixed material into the hopper as well as into the mixing chamber.

The objects and advantages of the apparatus for mixing particulate materials in a rapid and accurate manner are achieved by the mixer herein described and shown in the drawing.

DESCRIPTION OF PREFERRED EMBODIMENT

Figure 1:
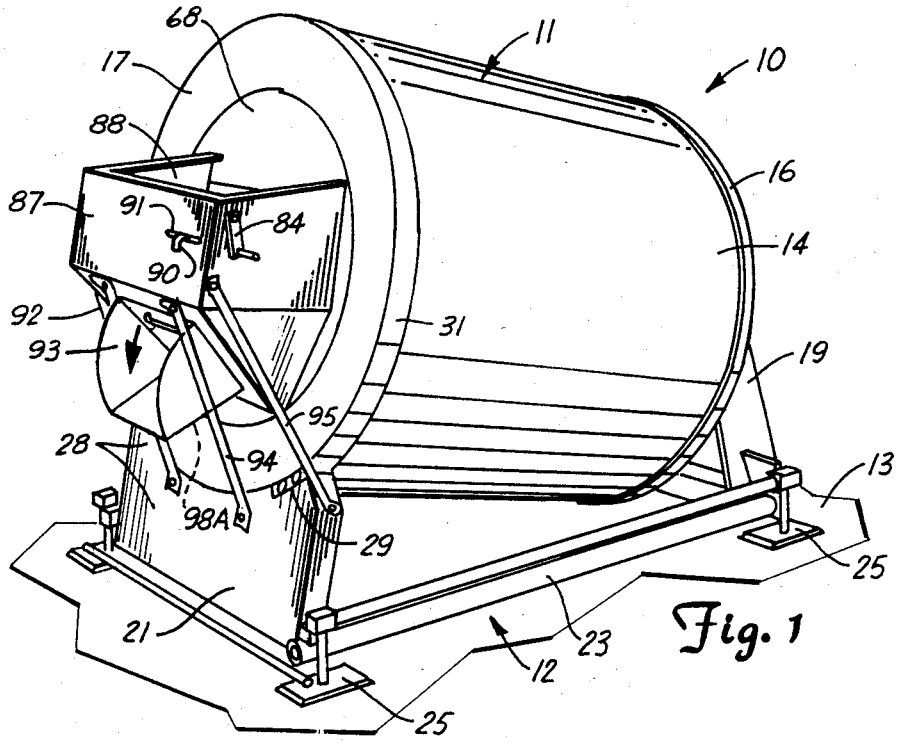
FIG. 1 is a perspective view of the material mixer of the invention.
Figure 2:
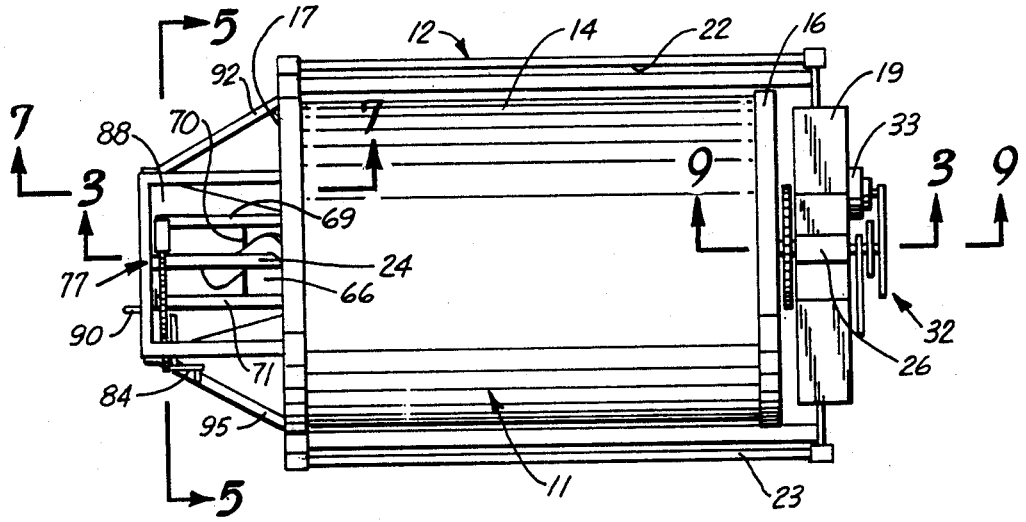
FIG. 2 is a top view thereof.

Referring to FIGS. 1 and 2, there is shown a material mixer indicated generally at 10 for mixing animal feeds and roughages and like particulate materials.

Mixer 10 is useable to mix granular and particulate materials, liquids, and semi-fluid products. The following description is directed to the use of the mixer to mix animal feeds, materials, grains, and roughages or forage. The mixed materials comprise rations for animals, such as dairy cattle, beef cattle, horses, hogs, and poultry. Quality controlled rations are essential to maximum animal production. Mixer 10 is operable to produce material mix quality and complete mixed material discharge control. Mixer 10 has an inclined cylindrical drum indicated generally at 11 rotatably mounted on a frame 12. Frame 12 is supported on the ground or surface 13, such as a feed room floor. Frame 12 allows the entire mixer 10 to be transported and set up in a desired location, such as a feed room. A balance beam scale (not shown) is used with frame 12 to provide the user with weight readings of the material placed in drum 11.

Drum 11 has a generally cylindrical side wall 14 attached to a drive circular end wall 16 and a feeding end wall 17. Walls 14, 16, and 17 surround a mixing chamber 18 for accommodating the feed materials. For example, drum 11 has a diameter of six feet and length that varys from four feet to eleven feet with a mixing capacity that is between 72 to 216 cubic feet. The diameter and length of drum 11 can vary to change its mixing capacity as desired.

Frame 12 has a rear stand 19 and a front stand 21 connected with a pair of side rails 22 and 23. Feet 25 secured to the corners of frame 12 support frame 12 on surface 13, such as a floor or ground.

Figure 3:
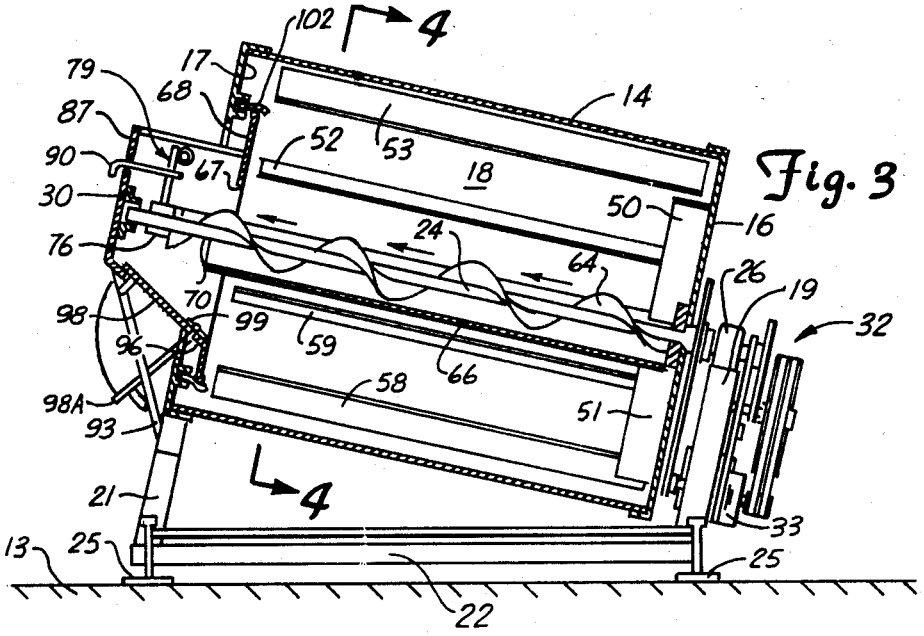
FIG. 3 is a sectional view taken along the line 3—3 of FIG. 2.
Figure 9:
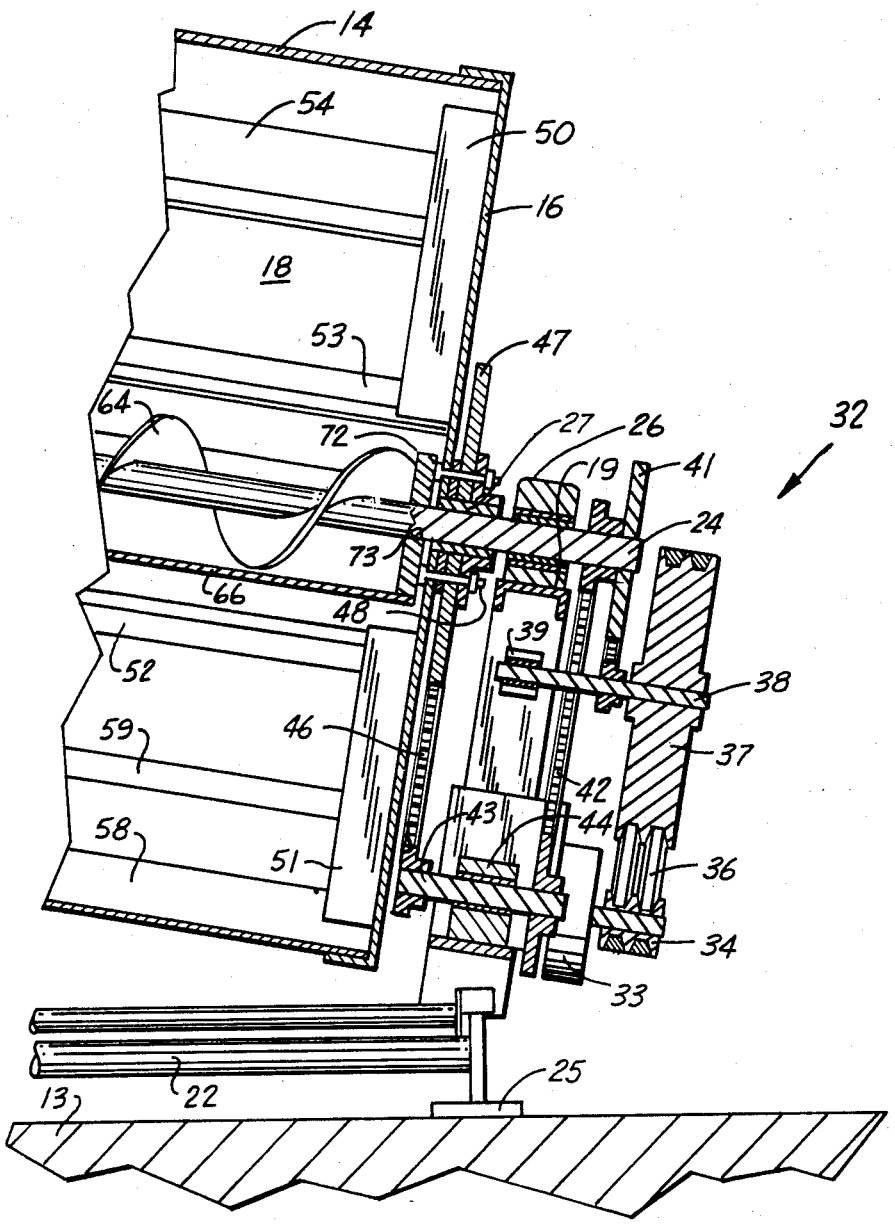
FIG. 9 is an enlarged sectional view taken along the line 9—9 of FIG. 2.

As shown in FIG. 9, the drive end wall 16 is rotatably mounted on the top of rear stand 19 with a shaft 24 rotatably accommodated in a bearing 26. Bearing 26 is a sleeve bearing mounted on the top of stand 19. Shaft 24 extends through a second bearing 27 that is secured to the center portion of end wall 16. As shown in FIG. 3, the front or upper end of shaft 24 is mounted on a bearing 30 secured to housing 87. Bearing 30 is at a higher elevation than bearing 26 locating shaft 24 and drum 11 about an inclined axis. The angle of inclination is 15 degrees upwardly from bearing 26. Other angles can be used. Bearings 27 and 30 allow drum 11 to rotate about the inclined axis of shaft 24, while allowing independent rotation of shaft 24 as hereinafter described.

Figure 5:
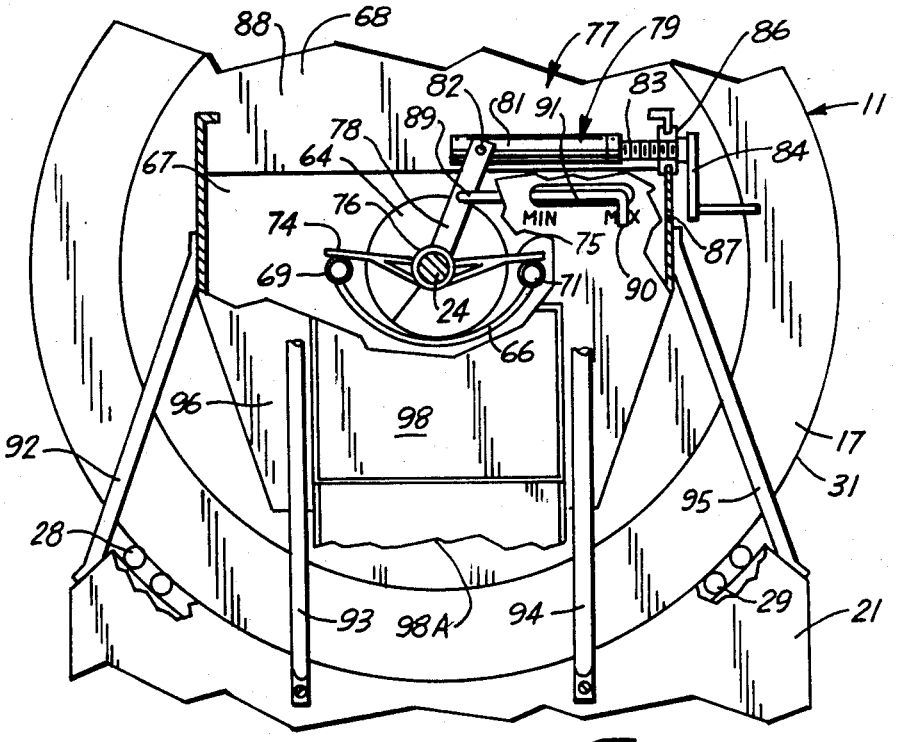
FIG. 5 is an enlarged sectional view taken along the line 5—5 of FIG. 2 showing the auger trough at the maximum or horizontal position.

As shown in FIG. 5, two pairs of rollers 28 and 29 mounted on the upper portions of stand 21 rotatably support the inlet end of drum 11. Rollers engage an outer rim 31 of end wall 17 thereby allowing drum 11 to rotate about a longitudinal inclined axis of shaft 24.

A positive drive apparatus indicated generally at 32, shown in FIGS. 2, 3, and 9, for rotating drum 11 has a motor and speed reducer 33 mounted on frame 12. Speed reducer 33 has a drive pulley 34 that is connected to a driven pulley 37 with a plurality of V-belts 36. Pulley 37 is splined to a shaft 38 that is rotatably supported on a bearing 39 mounted on support 19. A first chain and sprocket drive 41 drivably connects shaft 38 to shaft 24 thereby rotating shaft 24 on operation of the motor and speed reducer 33. A second chain and sprocket drive 42 joins shaft 24 to a shaft 43 located adjacent the bottom of support 19. A bearing 44 secured to support 19 rotatably carries shaft 43. The inner end of shaft 43 is drivably connected with a third chain and sprocket drive 46. Chain and sprocket drive 46 has a large sprocket 47 that is secured with a plurality of bolts 48 to the drum end wall 16 so that on operation of speed reducer 33 drum 11 will rotate about the axis of shaft 24. Other types of power transmission arrangements can be made to concurrently rotate shaft 24 and drum 11. A shield (not shown) is used to cover the drive apparatus 32.

Figure 4:
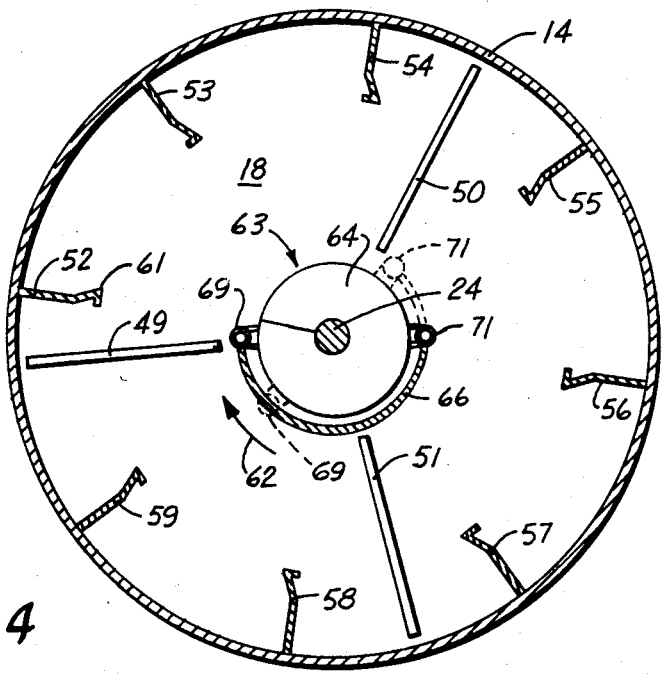
FIG. 4 is an enlarged sectional view taken along the line 4—4 of FIG. 3.
Figure 6:
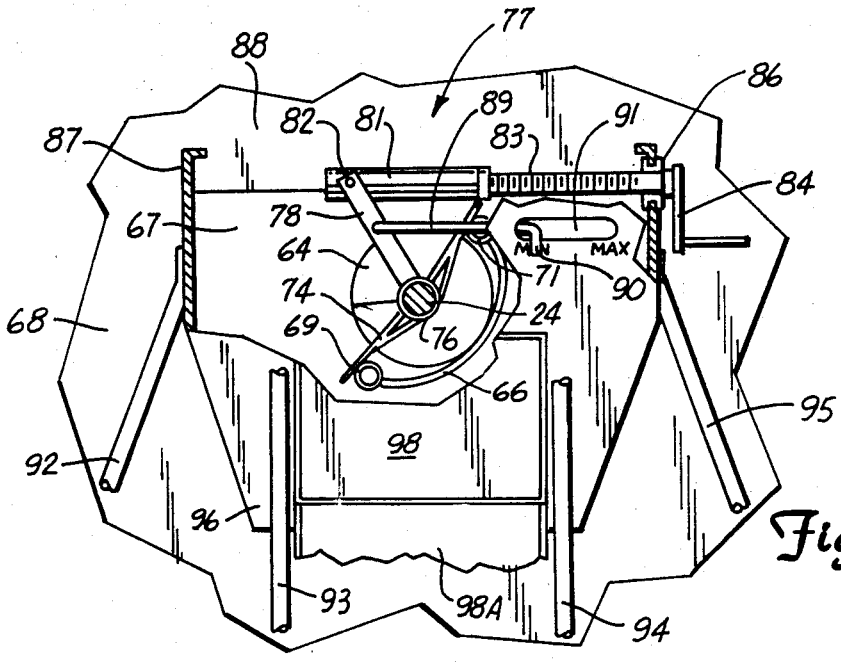
FIG. 6 is an enlarged sectional view similar to FIG. 5 showing the auger trough at the minimum or tilt position.

Referring to FIGS. 3, 4, and 9, a plurality of inwardly extended circumferentially spaced radial blades 49, 50, and 51 are secured to the inside of end wall 16. Blades 49–51 are linear sheet members or plates spaced between a plurality of longitudinal paddles 52–59 secured to the inside of cylindrical side wall 14. Referring to paddle 52, as shown in FIG. 4, the paddle 52 is a linear sheet member or plate that extends radially inward into the chamber 18 and terminates in a forwardly curved hooked end 61. Each of the paddles 53–59 has a similar hooked end. The number and circumferential arrangement of paddles used with the drum can vary as needed. On operation of drive apparatus 32, drum 11 rotates in the direction of the arrow 62. Paddles 52–59 carry the feed materials from the bottom of chamber 18 to the top of the chamber where it falls back into the mid-section of chamber 18 and moves down toward end wall 16. Blades 49–51 pick up the material adjacent the rear end wall 16 and carry the material from the bottom of chamber 18 to the top of the chamber where it falls into a generally longitudinal open top conveyer indicated generally at 63. Part of the feed material is picked up by paddles 52–59 and directed toward the mid-section of chamber 18. Conveyor 63 carries the feed material to the front or upper end of the drum where it is discharged back into hopper 87 and directed into the upper end of chamber 18. Conveyor 63 has a continuous helical flight or auger 64 secured to and extended along shaft 4. A generally U-shaped trough 66 surrounds the lower portion or lower arcuate half of auger 64 and extends from rear wall 16 through an opening 67 in a front wall 68. The entire top of trough 66 is open. The upper or discharge end 70 of trough 66, as seen in FIGS. 2 and 3 extends a short distance into material inlet housing or hopper 87 and spaced from the outside wall of the housing. Auger 64 extends beyond the end 70 of trough 66 so that the auger discharges the material into the hopper chamber as hereinafter described. The material flows back into the mixing chamber 18 and goes through another mixing cycle. The rate at which material is moved into hopper 87 by auger 66 determines the time of the mixing cycles. This rate is adjustable as herein described. A pair of tubes 69 and 71 are secured to the top edges of U-shaped trough 66 adjacent the opposite sides of auger 64. The first or rear ends of tubes 69 and 71 are secured to an end wall 72 of trough 66. End wall 72 has a hole 73 accommodating the shaft 24 as seen in FIG. 9. Referring to FIGS. 5 and 6, the opposite or front ends of the tubes 69 and 71 are secured by welds to a cross member 74 which includes a sleeve 76 rotatably mounted on shaft 24. The wall 72 and sleeve 76 supports trough 66 on shaft 24 and allows angular movement of trough 66 relative to shaft 24 and auger 64.

A control indicated generally at 77, as shown in FIG. 5, is used to angularly move trough 66 from a generally horizontal or maximum position, as shown in FIG. 5, to an angular or minimum tilt position, as shown in FIG. 6. Control 77 also holds trough 66 in a selected position at or anywhere between the horizontal position or full tilt position. When trough 66 is in the full tilt position, tube 69 is located adjacent the lower portion of auger 64 so that on rotation of auger 64, the feed material in trough 66 is fed into chamber 18 along the length of trough 66. When trough 66 is in the horizontal position, as shown in FIG. 5, the material is moved by auger 64, along trough 66 and is fed into a hopper or open top housing 87 mounted on front wall 68. This results in rapid cycling of materials in the mixing chamber 18. Control 77 is a manually operated mechanism that has an upwardly directed lever arm 78 secured to the top of sleeve 76. A linear actuator 79 is pivotally connected to the upper end of lever arm 78 and is used to angularly move lever arm 78 to change the angular position of trough 66 between its horizontal and tilt positions. Linear actuator 79 is shown as having a threaded sleeve 81 pivotally connected with pivot pin 82 to the upper end of lever arm 78. The opposite end of threaded sleeve 81 accommodates a threaded rod 83 that is secured to a crank handle 84. A bearing 86 mounts rod 3 on housing 87. The handle 84 is rotated to change the length of the linear actuator 79 and thereby change the angular position of trough 66 between its horizontal and tilt positions. Other types of linear actuators and extendible and contractible structures including air cylinders and power driven actuators can be used to change the angular position of trough 66.

Housing 87 is a box-like hopper having an open top 88 secured to the front wall 68. An indicator rod 89 is connected to the mid-section of lever arm 78. The opposite end 90 of rod 89 is a pointer that extends through a slot 91 in housing 87 to provide a visual indication of the angular position of trough 66. Visual indicia MIN and MAX on the front of housing 87 shows the location of end 90 and horizontal position or angular position of trough 66.

As shown in FIGS. 1 and 5, a plurality of generally upright legs 92, 93, 94 and 95 are secured to hopper 87 and stand 21 to hold hopper 87 in a fixed position. Hopper 87 has a downwardly inclined bottom wall 96 having an opening 97 for allowing material to flow out of the material mixer 10. Opening 97 is normally closed with a door 98. A mixed material discharge chute 98A is secured to the lower edge of the outside of door 98 to direct material to conveyors or feed carts. A transverse hinge 99 pivotally mounts door 98 and chute 98A on bottom wall 96. Door 98 can be pivoted to an up position to open opening 97 to allow the mixed material discharge from the end of conveyor 63 to flow out of hopper 87 via chute 98A. Other arrangeent of door structure can be used to close opening 97 and function as a material discharge chute when the door is in its open position.

Figure 7:
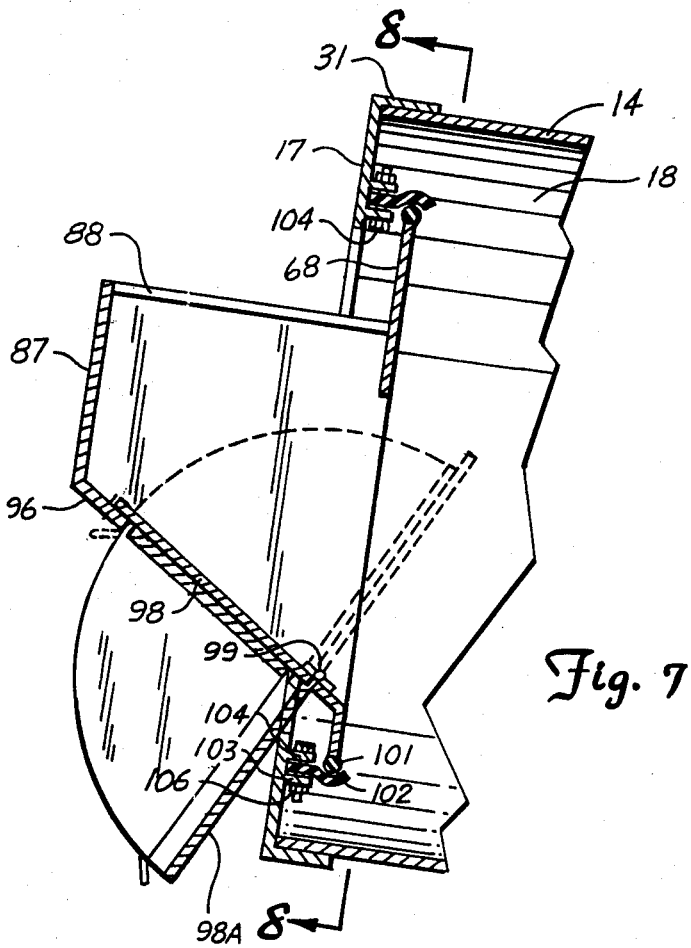
FIG. 7 is an enlarged sectional view taken along the line 7—7 of FIG. 2.
Figure 8:
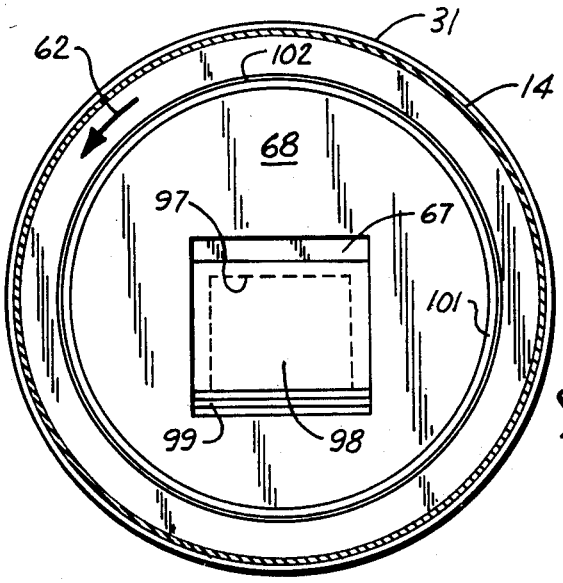
FIG. 8 is a sectional view taken along the line 8—8 of FIG. 7.

Referring to FIGS. 7 and 8, a circular bead or rod 101 is secured to the outer circular edge of front wall 68. A flexible sealing belt or ring 102 extends over bearing 101 to prevent material from flowing from chamber 18. A pair of angular members 103 and 104 are clamped to sealing ring 102 with a plurality of bolts 106. One of the annular members 103 is secured to end wall 17 whereby the flexible sealing ring 102 rotates around the front end wall 68. Sealing ring 102 is a flat plastic or rubber annular belt that is biased into engagement with circular bead 101. Circular bead 101 is slightly larger than the diameter of the sealing ring 102 whereby the ring 102 is flexed outwardly and maintained in sliding sealing engagement with bead 101.

In use, selected animal feeds, minerals, concentrates, and roughages and the like particulate materials are placed into hopper 87 through its open top 88. Liquid additives can also be placed in hopper 87. The ratios of these materials are selected by the herdsman in accordance with the ration requirements of the animals. A scale (not shown) is usable to determine the weight ratios of the materials that are mixed in mixer 10. Hopper 87 is in alignment with the drum inlet opening 97 so that the materials flow into the inlet end of mixing chamber 18. Drive apparatus 32 operates to concurrently rotate drum 11 and conveyor 63. The inwardly directed paddles 52–59 secured to the inside of the cylindrical drum wall 14 pick up the materials from the bottom of mixing chamber 18 and move the materials to the upper portion of the mixing chamber. The materials then fall back down into the bottom of the chamber with some of the materials falling into the open top conveyor 63. Drum 11, being located at an incline, will direct the materials to the rear end wall 16. The blades 49–51 will pick up the materials in the rear or lower end of mixing chamber 18 and carry the materials in an upward direction. The materials slide off of the upper blades into the lower end of conveyor 63. Drive apparatus 32 functions to rotate the auger 64 to move the materials along trough 66 in an upward direction toward hopper 87. When trough 66 of conveyor 63 is in its horizontal position, the maximum amount of materials are moved by auger 64 into hopper 87. This material flows back into the inlet of mixing chamber 18. This process is continual and causes a rapid mixing cycle of the materials through mixing chamber 18. The rate of the mixing cycle can be changed by changing the angular or tilt position of trough 66. As shown in broken lines in FIG. 4, trough 66 is moved to a position wherein edge 63 is located adjacent the lower side of auger 64 so that the auger will feed the materials over tubular member 69 back into mixing chamber 18. This reduces the amount of material that is moved by auger 64 into hopper 87. The result is that the cycling rate of the materials through mixing chamber 18 is reduced.

Control 77 is used to change the angular position of trough 66 of conveyor 63 from a generally horizontal position, as shown in FIG. 5, to a full tilt position, as shown in FIG. 6. Control 77 functions to hold trough 66 in its selected position which can vary between the horizontal position of FIG. 5 and the full tilt position of FIG. 6. Control 77 has a linear actuator 69 that is manually extendible and contractible to change the angular position of trough 66 relative to auger 64.

Upon completion of the mixing of the materials in mixing chamber 18, the door 98 is moved upwardly to an open position. This locates door 98 adjacent the bottom of the outer upper end 70 of trough 66. The auger 64, upon rotation, will move the materials along trough 66 through opening 97 into discharge chute 98A. Material flows down chute 98A into selected locations, such as a conveyor or feed cart. The rate at which the material is discharged by the conveyor is dependent on the angular position of trough 66. When trough 66 is in the horizontal position shown in FIG. 5, the maximum rate of material is moved by auguer 64 into chute 98A. The rate can be reduced by changing the angular or tilt position of auger 66 as indicated in FIG. 6. Drum 11 continues to rotate as the material is being discharged by conveyor 63 into chute 98A.

While there has been shown and described a preferred embodiment of the material mixer of the invention, it is understood that changes in the structure, arrangement of structure, and parts as well as the utility of the material mixer may be made by those skilled in the art without departing from the invention. The invention is defined in the following claims.

I claim:

1. An apparatus for mixing materials comprising: a drum having longitudinal axis, an inlet end, a closed end, and a chamber for accommodating materials, housing means for directing materials to the inlet end of the drum for movement into the chamber, means supporting the drum for rotation about the longitudinal axis thereof and inclining the drum and the axis downwardly from the inlet end thereof, conveyor means located in said drum between said inlet end and closed end thereof operable to move mixed material from the closed end into the housing means, drive means for rotating the drum about the longitudinal axis thereof and operating said conveyor means, said conveyor means including open top trough means having a longitudinal axis, and means for moving materials along said trough means, means for angularly moving the trough means about the longitudinal axis thereof between a generally horizontal position to a tilt position, means mounted on the drum for moving materials in said chamber upwardly and allowing said materials to flow into said open top trough means, said means for moving the materials along said trough means operable to move the materials from the trough means back into the chamber when the trough means is in its tilt position and operable to move the materials into the housing means when the trough means is in its generally horizontal position, said housing means having means to allow said materials in the housing means be discharged to a selected location.

2. The apparatus of claim 1 wherein: the means supporting said drum includes an elongated shaft rotatably supporting the closed end of the drum, said trough means having means rotatably mounting the trough means on the shaft for angular movement about the axis of the shaft, said means for moving the materials comprising helical flight means secured to the shaft located along said trough means, said drive means being operable to rotate the drum and said shaft whereby materials in the chamber are moved upward in the chamber and fall into the open top trough means, said helical flight means being rotatable to move the materials relative to said trough means.

3. The apparatus of claim 2 wherein: the means for angularly moving the trough means includes extendible and contractible means mounted on the housing means and connected to the trough means operable to angularly move the trough means relative to said shaft between said horizontal and tilt positions.

4. The apparatus of claim 3 wherein: the extendible and contractible means comprises a first threaded member and a second threaded member cooperating with the first threaded member, arm means connecting the first threaded member to the trough means, and crank means connected to the second threaded member whereby rotation of the second threaded member with the crank means in one direction angularly moves the trough means to the tilt position and rotation of the crank means in a direction opposite the one direction angularly moves the trough means from the tilt position to the generally horizontal position.

5. The apparatus of claim 4 including: indicator means connected to the arm means providing visual information related to the angular position of the trough means.

6. The apparatus of claim 1 including: a plurality of blade members secured to said closed end of the drum, said blade members projected into said chamber and operable upon rotation of the drum to move materials upwardly in the chamber adjacent said closed end and allow materials to move downwardly into the open top of the trough means.

7. The apparatus of claim 6 wherein: said drum has a cylindrical side wall surrounding said chamber, and a plurality of circumferentially spaced paddles secured to said side wall, said paddles projected into the chamber and move the materials to the upper portion of said chamber and allow materials to fall down into the chamber and open top trough means.

8. The apparatus of claim 1 wherein: said trough means includes a generally U-shaped trough having linear upper ends, a first linear member secured to one end, and a second linear member secured to the other end of the trough, said first linear member movable below the axis of rotation of the shaft when the trough means is in the tilt position.

9. The apparatus of claim 8 wherein: the means supporting said drum includes an elongated shaft rotatably supporting the closed end of the drum, said trough means having means rotatably mounting the trough means on the shaft, said means for moving the materials along the trough means comprising helical flight means secured to the shaft located along said trough means, said drive means being operable to rotate the drum and said shaft whereby materials in the chamber are moved upwardly in the chamber and fall into the open top trough means, said helical flight means being rotatable to move the materials along said trough means.

10. The apparatus of claim 8 wherein: the means for angularly moving the trough means includes extendible and extractible means mounted on the housing means and connected to the trough means operable to rotate the trough means relative to said shaft between said horizontal and tilt position.

11. The apparatus of claim 10 wherein: the extendible and contractible means comprises a first threaded member and a second threaded member cooperating with the first threaded member, arm means connecting the first threaded member to the trough means, and crank means connected to the second threaded member whereby rotation of the second threaded member with the crank means in one direction angularly moves the trough means to the tilt position and rotation of the crank means in a direction opposite the one direction angularly moves the trough means from the tilt position to the generally horizontal position.

12. The apparatus of claim 8 including: a plurality of blade members secured to said closed end of the drum, said blade members projected into said chamber and operable upon rotation of the drum to move materials upwardly in the chamber adjacent said closed end and allow the materials to fall downwardly into the open top of the trough means.

13. The apparatus of claim 12 wherein: said drum has a cylindrical side wall surrounding said chamber and a plurality of circumferential spaced paddles secured to said side wall, said paddles projected into the chamber and operable to pick up materials in the bottom of the chamber and move the materials to the upper portion of said chamber and allow materials to fall down into the chamber and open top trough means.

14. The apparatus of claim 1 wherein: said drum has an annular end wall at the inlet end thereof, said housing means including a stationary generally circular wall surrounded by said annular end wall, and flexible circular seal means between said annular end wall and circular wall operable to prevent materials from flowing out of the drum.

15. The apparatus of claim 14 wherein: the circular wall has a circular outer peripheral edge, said seal means includes a flexible annular member secured to the annular end wall and engageable with said circular edge.

16. The apparatus of claim 15 wherein: said outer peripheral edge is part of a circular bead on said circular wall.

17. An apparatus for mixing materials comprising: means having a chamber for accommodating materials, means for moving said materials in said chamber to mix the materials, conveyor means located in said chamber operable to move mixed materials back into the chamber and discharge materials from said chamber, said conveyor means including open top trough means having a longitudinal axis, and means for moving materials along said trough means, means for angularly moving the trough means about the longitudinal axis thereof between a generally horizontal position to a tilt position, said means for moving materials along said trough means operable to move the materials from the trough means back into the chamber when the trough means is in its tilt position and operable to move the materials to a discharge location when the trough means is in its generally horizontal position.

18. The apparatus of claim 17 wherein: said conveyor means includes an elongated shaft, said trough means having means mounting the trough means on the shaft for angular movement about the axis of the shaft, said means for moving the materials comprising helical flight means secured to the shaft located along said trough means, and drive means operable to rotate said shaft whereby said helical flight means moves the materials relative to said trough means.

19. The apparatus of claim 18 wherein: the means for angularly moving the trough means includes extendible and contractible means connected to the trough means operable to angularly move the trough means relative to said shaft between said horizontal and tilt positions.

20. The apparatus of claim 19 wherein: the extendible and contractible means comprises a first threaded member and a second threaded member cooperating with the first threaded member, are means connecting the first threaded member to the trough means, and crank means connected to the second threaded member whereby rotation of the second threaded member with the crank means in one direction angularly moves the trough means to the tilt position and rotation of the crank means in a direction opposite the one direction angularly moves the trough means from the tilt position to the generally horizontal position.

21. The apparatus of claim 20 including: indicator means connected to the arm means providing visual information relative to the angular position of the trough means.

22. The apparatus of claim 17 wherein: said means for moving said material is said chamber includes a plurality of blade members movable relative to said chamber to move materials upwardly in the chamber and allow the materials to fall downwardly into the open top of the trough means.

23. The apparatus of claim 22 wherein: said means for moving the material in said chamber further includes a plurality of circumferentially spaced paddles movable about said conveyor means and operable to pick up materials in the chamber and move the materials to upper portion of the chamber and allow the materials to fall down into the chamber and open top trough means.

24. An apparatus of claim 17 wherein: the means having a chamber for accomodating materials comprises: a generally cylindrical drum having an inlet end and an annular end wall at the inlet end thereof surrounding said chamber, housing means for directing materials into the inlet end of the drum for movement into the chamber, said housing means including a stationary generally circular wall surrounded by said annular end wall, and flexible circular seal means between said annular end wall and circular wall operable to prevent materials from flowing out of the chamber.

25. The apparatus of claim 24 wherein: the circular wall has a circular outer peripheral edge, said seal means including a flexible annular member secured to the annular end wall and engagement with said circular edge.

26. The apparatus of claim 25 wherein: said outer peripheral edge is part of a circular bead in said circular wall.

27. An apparatus for handling and discharging materials to selected locations comprising: conveyor means operable to move materials from and discharge the materials to separate selected locations, said conveyor means including open top trough means having a longitudinal axis, and means for moing materials along said trough means, means for angularly moving the trough means about the longitudinal axis thereof between a generally horizontal position to a tilt position, means for moving materials into the open top of the trough means, said means for moving the materials along said trough means operable to move the materials from the trough means to a first selected location when the trough means is in its tilt position and operable to move the materials to a second selected location when the trough means is in its genrally horizontal position.

28. The apparatus of claim 27 wherein: said conveyor means includes an elongated shaft, said trough means having means mounting the trough means on the shaft for angular movement about the axis of the shaft, said means for moving the materials comprising helical flight means secured to the shaft located along said trough means, and drive means operable to rotate the shaft whereby the materials in the trough means are moved by the helical flight means relative to said trough means for discharge to one of said selected locations.

29. The apparatus of claim 28 wherein: the means for angularly moving trough means includes extendible and contractible means connected to the trough means operable to angularly move the trough means relative to said shaft between said horizontal and tilt positions.

30. The apparatus of claim 29 wherein: the extendible and contractible means comprises a first threaded member and a second threaded member cooperating with the first threaded member, arm means connecting the first threaded member to the trough means and crank means connected to the second threaded member whereby rotation of the second threaded member with the crank means in one direction angularly moves the trough means to the tilt position and rotation of the crank means in a direction opposite the one direction angularly moves the trough meand to the tilt position to the generally horizontal position.

31. The apparatus of claim 30 including: indicator means connected to the arm means providing visual information related to the angular position of the trough means.

* * * * *